US010344967B2

(12) United States Patent
Hashiguchi et al.

(10) Patent No.: US 10,344,967 B2
(45) Date of Patent: Jul. 9, 2019

(54) BURNER TIP, COMBUSTION BURNER, AND BOILER

(71) Applicant: MITSUBISHI HITACHI POWER SYSTEMS, LTD., Kanagawa (JP)

(72) Inventors: Kazuaki Hashiguchi, Tokyo (JP); Akiyasu Okamoto, Tokyo (JP); Hideyuki Hamaya, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 358 days.

(21) Appl. No.: 15/025,656

(22) PCT Filed: Oct. 2, 2014

(86) PCT No.: PCT/JP2014/076387
§ 371 (c)(1),
(2) Date: Mar. 29, 2016

(87) PCT Pub. No.: WO2015/060089
PCT Pub. Date: Apr. 30, 2015

(65) Prior Publication Data

US 2016/0223192 A1 Aug. 4, 2016

(30) Foreign Application Priority Data

Oct. 21, 2013 (JP) ..... 2013-218653

(51) Int. Cl.
*F23D 14/62* (2006.01)
*F23D 11/38* (2006.01)

(52) U.S. Cl.
CPC ..... *F23D 11/38* (2013.01)

(58) Field of Classification Search
CPC .... F23D 17/002; F23D 11/102; F23D 11/402; F23D 17/00; F23D 11/104; F23D 14/76;
(Continued)

(56) References Cited

U.S. PATENT DOCUMENTS 3,913,845 A 10/1975 Tsuji
2005/0058958 A1* 3/2005 Kobayashi ..... F23C 5/32 431/10

FOREIGN PATENT DOCUMENTS

DE 3048044 A1 * 7/1982 ..... F23M 9/06
GB 557142 A * 11/1943 ..... F23D 14/48
(Continued)

OTHER PUBLICATIONS

Baba English translation.*
(Continued)

*Primary Examiner* — Jason Lau
(74) *Attorney, Agent, or Firm* — Wenderoth, Lind & Ponack, L.L.P.

(57) ABSTRACT

In a burner tip, combustion burner, and boiler, the burner tip is provided with: a mixing chamber provided at an inner portion of the tip body; a plurality of first mixed fluid jet holes of which base end portions communicate with the mixing chamber, of which front end portions open on a lateral side of the tip body, and which are placed in circumferential direction of the tip body at predetermined intervals; a fluid fuel supply passage configured to supply a fluid fuel to the mixing chamber; and an atomizing medium supply passage configured to supply an atomizing medium to the mixing chamber, thereby, combustibility is improved by facilitating the mixing of a fluid fuel and an atomizing medium and thus making the size of liquid fuel droplets smaller.

9 Claims, 6 Drawing Sheets

(58) Field of Classification Search
CPC . F23D 2900/00015; F23D 2900/00016; F23D 11/10; F23D 11/107; F23D 11/24; F23D 1/005; F23D 11/007; F23D 11/103; F23D 11/36; F23D 11/42; F23D 14/32; F23D 2204/10; F23D 2214/00; F23D 2900/00014; F23D 11/001; F23D 11/101; F23D 11/105; F23D 11/12; F23D 11/34; F23D 11/38; F23D 11/408; F23D 14/00; F23D 14/24; F23D 14/52; F23D 14/64; F23D 1/00; F23D 2211/00; F23D 2900/00013; F23D 2900/00018; F23D 2900/11101; F23D 2900/14004
See application file for complete search history.

(56) References Cited

FOREIGN PATENT DOCUMENTS

| | | |
|---|---|---|
| JP | 49-107727 | 9/1974 |
| JP | 52-140926 | 11/1977 |
| JP | 60-86720 | 6/1985 |
| JP | 61-13128 | 1/1986 |
| JP | 61-53639 | 4/1986 |
| JP | 63-49615 | 3/1988 |
| JP | 1-281309 | 11/1989 |
| JP | 6-94217 | 4/1994 |
| JP | 7-318049 | 12/1995 |
| JP | 8-1288 | 1/1996 |
| JP | 2003-172505 | 6/2003 |
| JP | 2004-225919 | 8/2004 |
| JP | 2008-45836 | 2/2008 |
| JP | 2010-127518 | 6/2010 |

OTHER PUBLICATIONS

English translation of the Written Opinion of the International Searching Authority dated Jan. 6, 2015 in corresponding International Application No. PCT/JP2014/076387.
Decision of a Patent Grant dated Jun. 14, 2016 in corresponding Japanese Application No. 2013-218653 (with English translation).
International Search Report dated Jan. 6, 2015 in corresponding International Application No. PCT/JP2014/076387.
Notification of Reasons for Refusal dated Jan. 27, 2016 in corresponding Japanese Application No. 2013-218653 (with English translation).

* cited by examiner

BURNER TIP, COMBUSTION BURNER, AND BOILER

FIELD

The present invention relates to a burner tip that mixes a fluid fuel with an atomizing medium to turn them into a spray and jets them, a combustion burner that produces a flame with the mixture of the fluid fuel and atomizing medium jetted from the burner tip, and a boiler that uses the combustion burner.

BACKGROUND

A commonly used oil combustion boiler includes a furnace that is hollow inside and is placed in a vertical direction, and a plurality of combustion burners is provided along a circumferential direction on the wall of the furnace and is placed in a plurality of stages in a perpendicular direction. The combustion burner produces a flame by turning a liquid fuel into a spray with an atomizing medium and blowing the atomized liquid fuel into the furnace so as to enable the combustion in the furnace. A flue gas duct is connected to the upper portion of the furnace. The flue gas duct is provided, for example, with a superheater, reheater, economizer for recovering the heat of the flue gas. This causes the heat exchange between the flue gas generated by the combustion in the furnace and water. This can generate steam.

The combustion burner used in the oil combustion boiler is provided with a burner tip at the front end portion of the supply pipe of the liquid fuel and atomizing medium. The burner tip can jet the liquid fuel and atomizing medium from a plurality of jet holes formed on the front end after mixing the liquid fuel and the atomizing medium. When a fuel that generates a lot of NOx or soot dust, such as a heavy fuel, is used in the burner tip, the reduction in the NOx or soot dust is required while a high combustibility is maintained. In light of the foregoing, the increase in the number of jet holes in the burner tip can be considered. However, the increase in the number of jet holes shortens the distance between the adjacent jet holes. This causes the jet flows to interfere with each other and each of the jet flows to get into a film state. This makes it difficult to take in the surrounding air. There is a risk of ignition failure or combustion failure.

A burner tip configured to solve the problem is described, for example, in Patent Literature 1. An internal mixing type atomizer described in Patent Literature 1 is provided with a fuel supply passage, an atomizing medium supply passage that atomizes the fuel, a mixing chamber that mixes the fuel supplied from the fuel supply passage with the atomizing medium supplied from the atomizing medium passage, and an jet hole that jets a mixed fluid in the mixing chamber to the outside. Furthermore, in the burner tip described in Patent Literature 2, a plurality of atomizing medium jet holes radially extends from an atomizing medium chamber, and a mixture jet hole is formed as an extension of each of the front ends and the mixture jet holes open on the front end of the burner tip. A fuel jet hole extends from a liquid fuel chamber and the front end of the fuel jet hole opens on the side surface of the mixture jet hole.

CITATION LIST

Patent Literature

Patent Literature 1: JP 63-049615 A
Patent Literature 1: JP 2010-127518 A

SUMMARY

Technical Problem

As the burner tip, as in Patent Literature 1, there is a burner tip that mixes the atomizing medium with the fluid fuel in a mixing chamber provided inside and then ejects the mixture from the jet hole, and as in Patent Literature 2, there is a burner tip that mixes the fluid fuel with respect to the atomizing medium and then ejects the mixture, by connecting the fuel jet hole to the middle portion of the mixture jet hole. In the burner tip, as in Patent Literature 2, by arranging a plurality of mixture jet holes in the radial direction and in the circumferential direction at predetermined gaps, it is possible to prevent interference between the jet flows of the mixture and improve combustibility, while improving the atomization of the fluid fuel. However, in the case of the internal mixing type burner tip having the mixing chamber, the diffusion of the fluid fuel using the atomizing medium in the mixing chamber is liable to become insufficient.

The invention has been made to solve the above-described problems, and an object thereof is to provide a burner tip, a combustion burner, and a boiler capable of reducing an atomized particle size of the fluid fuel and improving the combustibility, by promoting the mix between the fluid fuel and the atomizing medium.

Solution to Problem

According to an aspect of the present invention, a burner tip includes: a tip body; a mixing chamber provided inside the tip body; a plurality of first mixed fluid jet holes, a base end of which communicates with the mixing chamber, a front end of which is open to a lateral side of the tip body, and which is disposed at predetermined intervals in a circumferential direction of the tip body; a fluid fuel supply passage that supplies fluid fuel to the mixing chamber; and an atomizing medium supply passage that supplies atomizing medium to the mixing chamber.

Therefore, the fluid fuel supplied from the fluid fuel supply passage and the atomizing medium supplied from the atomizing medium supply passage are mixed with each other in the mixing chamber, and the fluid mixture is ejected to the outside by the first mixed fluid jet hole. At this time, since the first mixed fluid jet hole is open to the lateral side of the tip body, each atomization of the fluid mixture ejected from each of the first mixed fluid jet holes is hard to come into contact with each other, and it is possible to reduce the atomized particle size of the fluid fuel by promoting the mix between the fluid fuel and the atomizing medium. As a result, it is possible to improve the combustibility by satisfactorily mixing the fluid fuel and the ambient air.

Advantageously, in the burner tip, the plurality of first mixed fluid jet holes are radially formed around a point located on an axis of the tip body.

Therefore, it is possible to reduce the manufacturing cost by improving the workability of the plurality of mixed fluid jet holes.

Advantageously, in the burner tip, the tip body includes a side wall section having a cylindrical shape along an axial direction, and a front end portion which is formed in a hemispherical shape and is disposed at one end portion of the side wall section, and the plurality of the first mixed fluid jet holes are formed to penetrate through the side wall section so as to extend to the front end portion side from the mixing chamber.

Therefore, by forming the plurality of first mixed fluid jet holes on the side wall section having a cylindrical shape, the fluid mixture can be ejected over a wide range, thereby facilitating the mix between the fluid fuel and the ambient air.

Advantageously, in the burner tip, the plurality of the first mixed fluid jet holes are provided on the side wall section in the plural to be parallel to each other at predetermined intervals in the axial direction.

Therefore, since the first mixed fluid jet holes provided at a predetermined interval in the axial direction are parallel to each other, each of the atomization of the fluid mixture ejected from each of the first mixed fluid jet holes is hard to come into contact with each other, and it is possible to promote the mix between the fluid fuel and the ambient air.

Advantageously, in the burner tip, a plurality of second mixed fluid jet holes, a base end of which communicates with the mixing chamber and a front end of which is open to a front side through the front end portion, are disposed at predetermined intervals in the circumferential direction, and the first mixed fluid jet holes and the second mixed fluid jet holes are disposed at the same position in the circumferential direction.

Therefore, since the first mixed fluid jet holes and the second mixed fluid jet holes are disposed at the same position in the circumferential direction, it is possible to promote the mix between the fluid fuel in each atomization of the fluid mixture ejected from each of the mixed fluid jet holes and the ambient air.

Advantageously, in the burner tip, a plurality of the atomizing medium supply passages are provided on a base end side of the tip body to allow to supply the atomizing medium to the mixing chamber along the axial direction, and a plurality of the fluid fuel supply passages are disposed on the base end side of the tip body on the outer side of the atomizing medium supply passages to allow to supply the fluid fuel to the mixing chamber along the radial direction.

Therefore, since the fluid fuel is supplied to the atomizing medium supplied to the mixing chamber from the outside, it is possible to secure a long residence time of the fluid fuel in the mixing chamber, and it is possible to promote the mix between the fluid fuel and the atomizing medium in the mixing chamber.

According to another aspect of the present invention, a combustion burner includes: a wind box; a fuel passage disposed in a central portion of the wind box; an air passage disposed outside the fuel passage in the wind box; a burner gun disposed in the central portion of the fuel passage; and the burner tip according to any one of the above disposed at a front end portion of the burner gun.

Thus, since the burner tip disposed at the front end portion of the burner gun is provided with a plurality of first mixed fluid jet holes disposed at predetermined intervals in the circumferential direction of the tip body, a base end of the hole communicates with the mixing chamber and a front end of the hole is open to the lateral side of the tip body, each atomization of the fluid mixture ejected from each of the first mixed fluid jet holes is hard to come into contact with each other, and the fluid fuel and the ambient air are satisfactorily mixed with each other. As a result, it is possible to reduce the atomized particle size of the fluid fuel and improve the combustibility by promoting the mix between the fluid fuel and the atomizing medium.

According to still another aspect of the present invention, a boiler in which a fuel and air burn in a furnace that is hollow inside and heat is recovered by heat exchange in the furnace which includes the combustion burner disposed on a wall of the furnace.

Accordingly, placing the combustion burner on the furnace wall facilitates the mix of the fluid fuel and the atomizing medium. This can reduce the atomized particle size of the fluid fuel and thus can improve the combustibility.

Advantageous Effects of Invention

In the burner tip, combustion burner, boiler of the present invention, a plurality of first mixed fluid jet holes disposed at predetermined intervals in the circumferential direction of the tip body are provided, the base end of which communicates with the mixing chamber, and the front end of which opens to the lateral side of the tip body. This facilitates the mix of the fluid fuel and the atomizing medium. This can reduce the atomized particle size of the fluid fuel and can improve the combustibility.

DESCRIPTION OF EMBODIMENTS

A preferred embodiment of the burner tip, combustion burner, and boiler of the present invention will be described in detail hereinafter with reference to the appended drawings. Note that the present invention is not limited to the present embodiment and, when there is a plurality of embodiments, the embodiments include a combination of the embodiments.

First Embodiment

Figure 6:
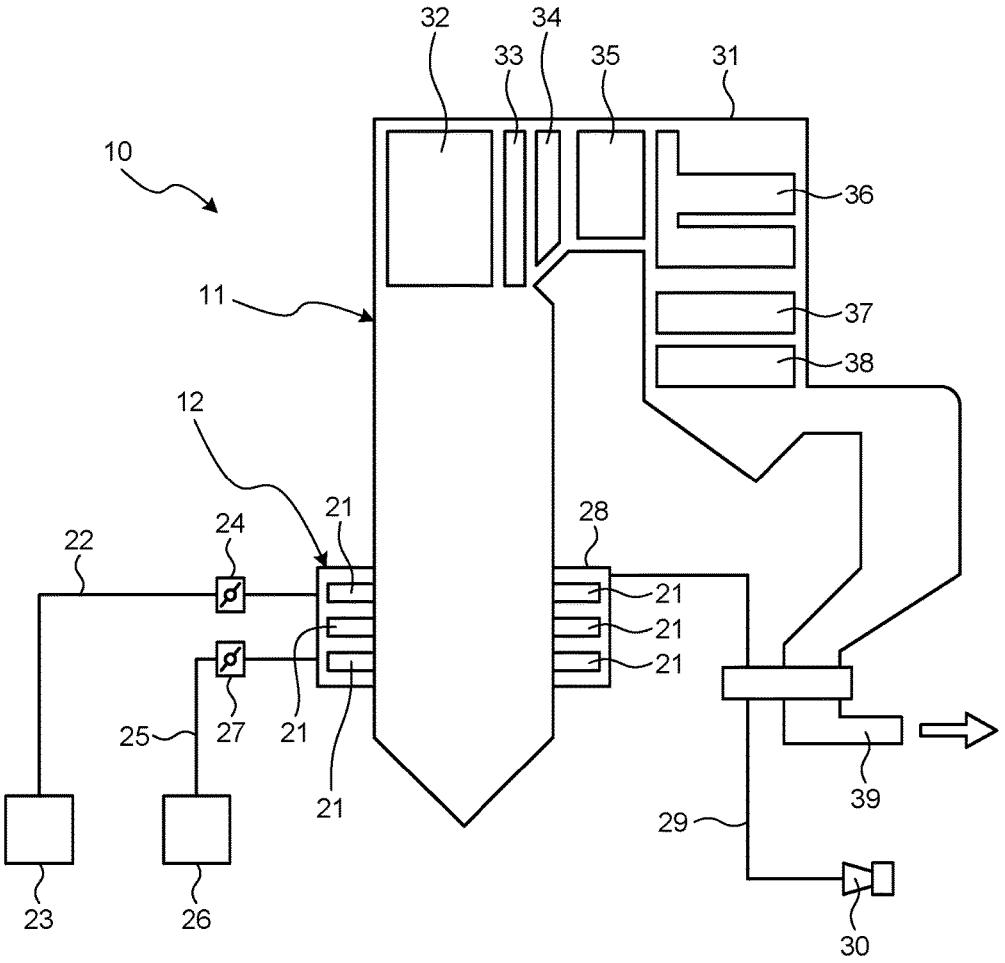
FIG. 6 is a schematic diagram of the configuration of an oil combustion boiler in the present embodiment.

FIG. 6 is a schematic diagram of the configuration of the oil combustion boiler in the first embodiment.

The oil combustion boiler in the present embodiment uses heavy oil (light oil, coal slurry, or the like) as the fluid fuel that is a fuel and atomizes the heavy oil using steam (a high-pressure air, a high-pressure gas, a combustible gas, or the like) as the atomizing medium in the combustion burner (burner tip), and then jets the fluid fuel to burn the jetted fluid fuel in the furnace. The boiler can recover the heat generated by the combustion.

An oil combustion boiler 10 in the present embodiment is a conventional boiler, and includes a furnace 11 and a combustion unit 12 as illustrated in FIG. 6. The furnace 11 is a square cylinder and is hollow inside. The furnace 11 is placed in a vertical direction. The combustion unit 12 is provided at the lower portion of the furnace wall of the furnace 11.

The combustion unit 12 includes a plurality of combustion burners 21 attached on the furnace wall. In the present embodiment, for example, four combustion burners 21 are placed at equal intervals in a circumferential direction as a set. For example, three sets, namely, three stages are placed in a vertical direction. Note that the placement and number of the combustion burners 21 are not limited to the embodiment.

Each of the combustion burners 21 is coupled to a fuel supply source 23 through a fuel supply pipe 22. A flow regulating valve 24 that can regulate the amount of fuel supply is provided on the fuel supply pipe 22. Each of the combustion burners 21 is further coupled to a steam supply source 26 through a steam supply pipe 25. A flow regulating valve 27 that can regulate the amount of steam supply is provided on the steam supply pipe 25. The furnace 11 is provided with a wind box 28 at a position at which each of the combustion burners 21 is installed. An end portion of an air duct 29 is coupled to the wind box 28. A blower 30 is coupled to the other end portion of the air duct 29.

Accordingly, fuel is supplied from the fuel supply source 23 through the fuel supply pipe 22 to each of the combustion burners 21 while steam is supplied from the steam supply source 26 through the steam supply pipe 25 to each of the combustion burners 21. A combustion air heated by the heat exchange with the flue gas is supplied from the air duct 29 through the wind box 28 to each of the combustion burners 21. Thus, the combustion burner 21 mixes and atomizes the fuel and the steam, and then jets them as a mixed fluid into the furnace 11, and jets the combustion air into the furnace 11. This can produce a flame in the furnace 11.

A flue gas duct 31 is coupled to the upper portion of the furnace 11. The flue gas duct 31 is provided with superheaters 32 and 33, reheaters 34 and 35, and economizers 36, 37, and 38 for recovering the heat of the flue gas as a convective heat transfer unit (heat recovery unit) such that the heat is exchanged between the flue gas generated by the combustion in the furnace 11 and water.

A flue gas pipe 39 through which the flue gas after the heat exchange is discharged is coupled to the downstream side of the flue gas duct 31. Although not illustrated, the flue gas pipe 39 is provided with a NOx removal unit, an electronic precipitator, an air induced blower, and desulfurizer, and is further provided with a stack at the downstream end portion.

Accordingly, when each of the combustion burners 21 of the combustion unit 12 injects the mixed fluid of the fuel and steam into the furnace 11, the mixed fluid and the air burn and a flame is produced in the furnace 11. When the flame is produced at the lower portion of the furnace 11, the burned gas (flue gas) rises in the furnace 11 and is discharged to the flue gas duct 31.

The water supplied from a water feed pump (not illustrated in the drawing) at that time is preheated with the economizers 36, 37, and 38. After that the water is heated and becomes saturated vapor while being supplied through a steam drum (not illustrated in the drawing) to each water pipe (not illustrated in the drawing) on the furnace wall, and then is sent to the steam drum (not illustrated in the drawing). The saturated vapor in the steam drum (not illustrated in the drawing) is further led to the superheaters 32 and 33 and is heated with the burned gas. The superheated steam generated in the superheaters 32 and 33 is supplied to a power plant (not illustrated in the drawing), for example, a turbine. The steam extracted in the middle of the expansion process in the turbine is led to the reheaters 34 and 35 to be superheated again, and is returned to the turbine. Note that, although being described as a drum type furnace (a steam drum), the furnace 11 is not limited to the structure.

After that, the flue gas passes through the economizers 36, 37, and 38 of the flue gas duct 31. And then, in the flue gas pipe 39, the NOx removal unit (not illustrated in the drawing) removes a toxic substance such as NOx from the flue gas using a catalyst, the electronic precipitator removes a particulate matter from the flue gas, and the desulfurizer removes a sulfur content from the flue gas. After that, the flue gas is discharged into the air through the stack.

Figure 7:
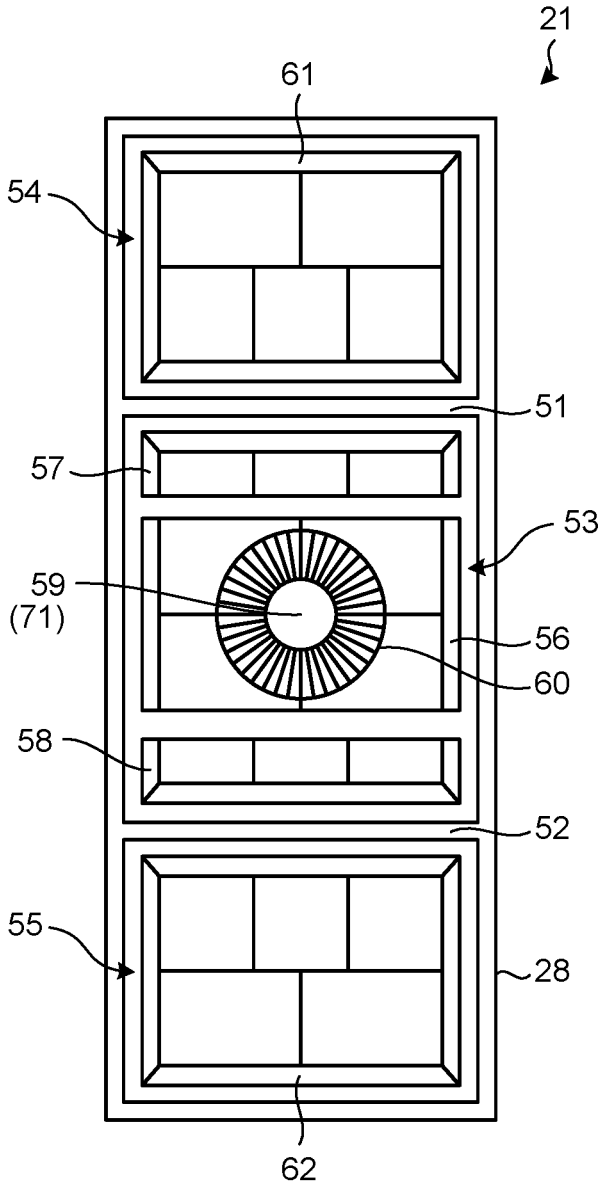
FIG. 7 is an elevation view of the entire configuration of the combustion burner.
Figure 8:
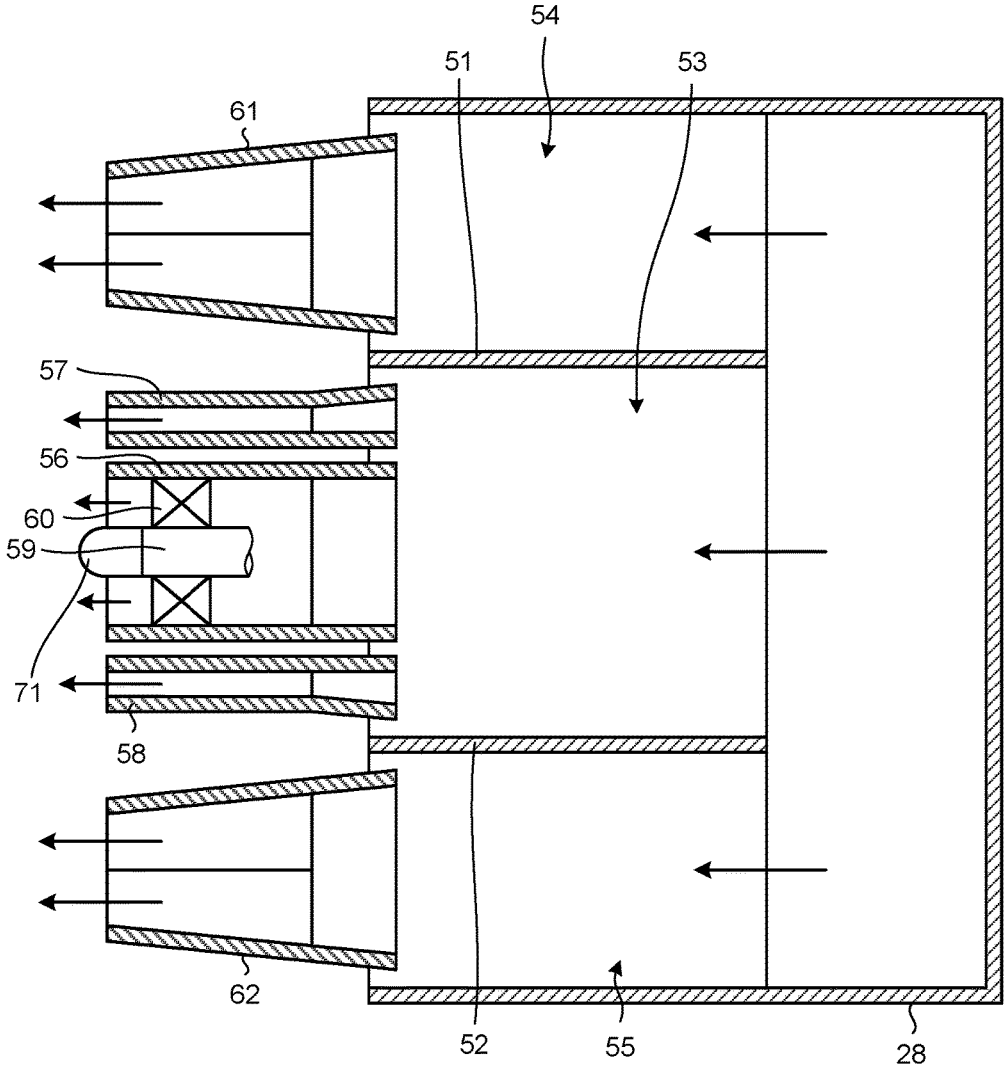
FIG. 8 is a cross-sectional view of the combustion burner.

First, the combustion unit 12 will be described in detail. The combustion burners 21 included in the combustion unit 12 have almost the same structure. FIG. 7 is an elevation view of the entire configuration of the combustion burner. FIG. 8 is a cross-sectional view of the combustion burner.

In the combustion burner 21, the wind box 28 has a box shape and is compartmentalized into a fuel compartment (fuel passage) 53, an upper supplementary air compartment (air passage) 54, and a lower supplementary air compartment (air passage) 55 with partition plates 51 and 52 as illustrated in FIG. 7 and FIG. 8. The fuel compartment 53 is placed at the vertically central portion of the wind box 28. The upper supplementary air compartment 54 is placed at the vertically upper portion of the wind box 28. The lower supplementary air compartment 55 is placed at the lower portion.

The fuel compartment 53 includes a fuel air nozzle 56, and upper and lower supplementary fuel air nozzles 57 and 58. A burner gun 59 is placed at the central portion of the fuel air nozzle 56 and a flame stabilizer 60 is placed around the burner gun. Meanwhile, the upper supplementary air compartment 54 includes a supplementary air nozzle 61 and the lower supplementary air compartment 55 includes a supplementary air nozzle 62. Note that the fuel air nozzle 56, the upper and lower supplementary fuel air nozzles 57 and 58, and the supplementary air nozzles 61 and 62 can be tilted up and down.

Accordingly, the combustion air is supplied to the fuel compartment 53, and each of the supplementary air compartments 54 and 55 in the wind box 28 at a predetermined flow ratio. A first air is sent to the fuel compartment 53. A second air is sent to each of the supplementary air compartments 54 and 55. The first air sent to the fuel compartment 53 is mostly jetted as an effective first air from the fuel air nozzle 56, and the supplementary fuel air nozzles 57 and 58 into the furnace 11 at a high speed. The second air sent to each of the supplementary air compartments 54 and 55 is mostly jetted from the supplementary air nozzles 61 and 62 into the furnace 11 at a high speed.

The fuel and steam are pumped into the burner gun 59 and are atomized to the furnace 11 using a burner tip 71 to be described below and attached at the front end portion of the burner gun 59. Then, the fuel and steam are ignited by an ignition source (not illustrated in the drawing) to produce a flame. The flame is held by a swirl flow when the effective first air passes through the flame stabilizer 60 and this maintains the combustion. The flame is maintained with the first air from near the ignition point to the first half of the flame, and is maintained with the effective second air from the last half until the completion of the combustion.

Figure 1:
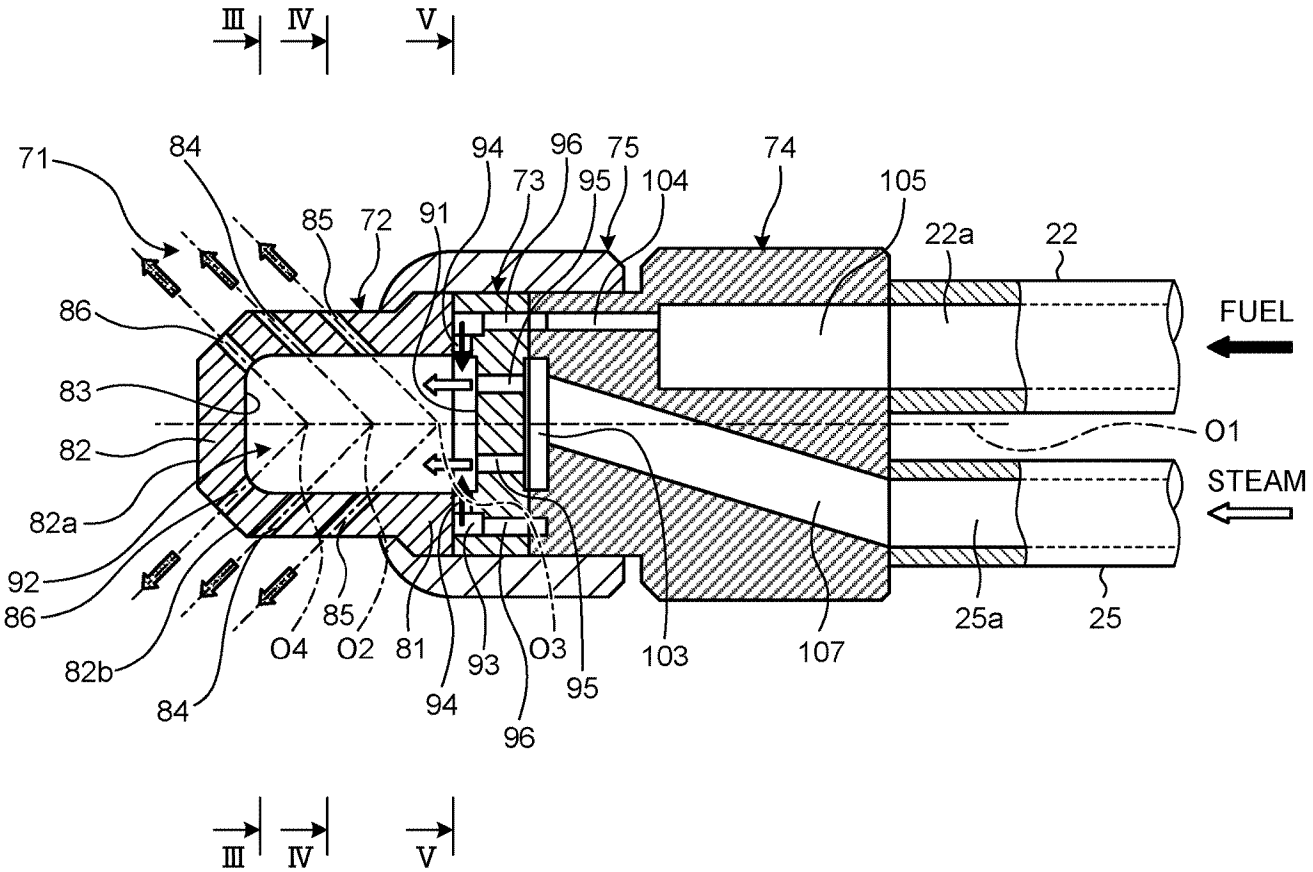
FIG. 1 is a cross-sectional view of a burner tip of this embodiment.
Figure 2:
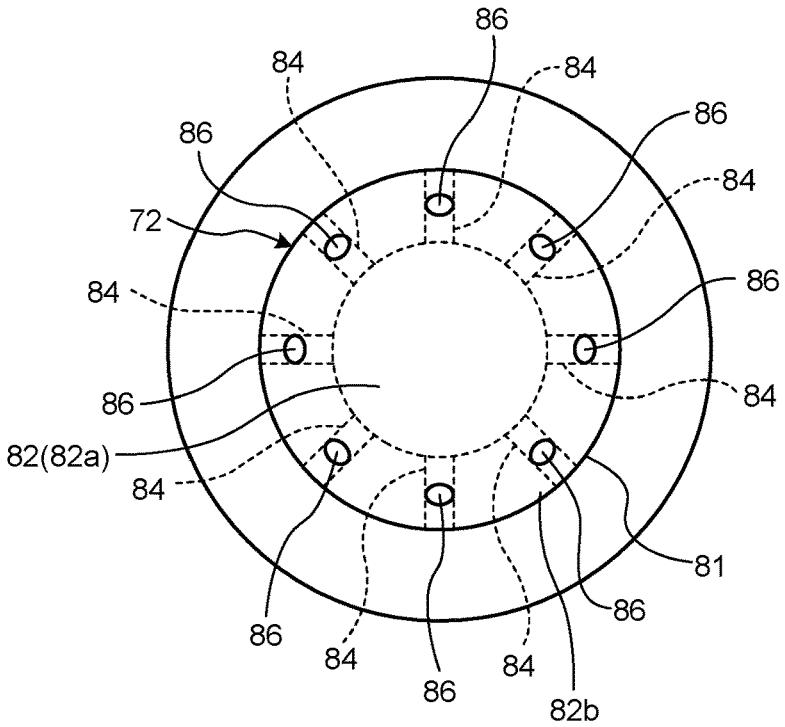
FIG. 2 is a front view of the burner tip.
Figure 3:
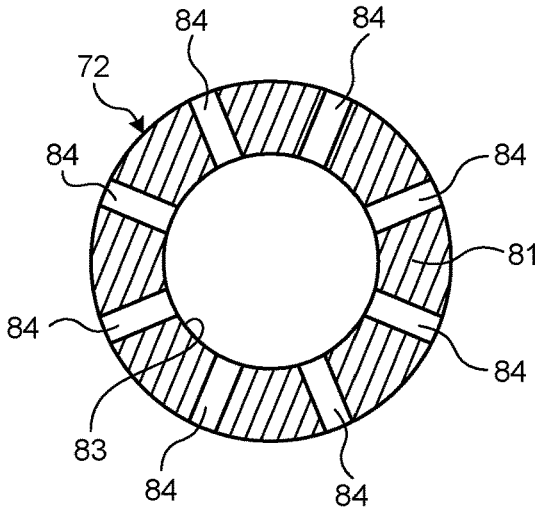
FIG. 3 is a cross-sectional view taken from a line III-III of FIG. 1 in the burner tip.
Figure 4:
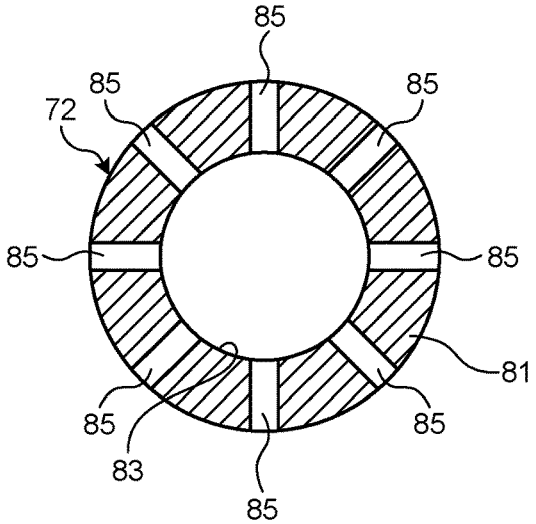
FIG. 4 is a cross-sectional view taken from a line IV-IV of FIG. 1 in the burner tip.
Figure 5:
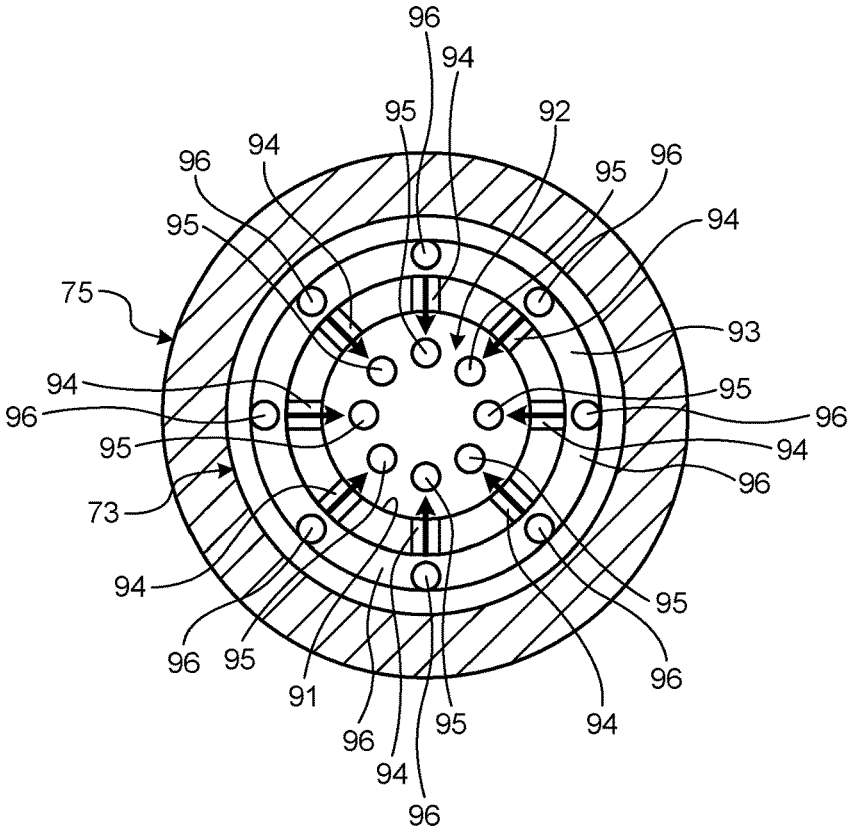
FIG. 5 is a cross-sectional view taken from a line V-V of FIG. 1 in the burner tip.

Next, the burner tip 71 will be described. FIG. 1 is a cross-sectional view of the burner tip of this embodiment, FIG. 2 is a front view of the burner tip, FIG. 3 is a cross-sectional view taken from a line III-III of FIG. 1 in the burner tip, FIG. 4 is a cross-sectional view taken from a line IV-IV of FIG. 1 in the burner tip, and FIG. 5 is a cross-sectional view taken from a line V-V in FIG. 1 in the burner tip.

As illustrated in FIGS. 1 to 5, a burner tip 71 has a spray plate 72, a back plate 73, and a connection plate 74, as a tip body, and is integrally connected by a clamping ring 75.

The spray plate 72 has a shape (a right side in FIG. 1), in which a base end is open and a front end (a left side in FIG. 1) is blocked. That is, the spray plate 72 has a side wall section 81 having a cylindrical shape along an axis O1 direction, and a front end portion 82 forming a hemispherical shape provided at one end portion of the side wall section 81, and the front end portion 82 has a front end surface section 82*a* and an inclined surface section 82*b*. The spray plate 72 is formed with a first recess 83 that forms a cylindrical shape to open to the base end portion. Also, in the spray plate 72, a plurality of first mixed fluid jet holes 84 and 85 are formed at the side wall section 81, and a plurality of second mixed fluid jet holes 86 are formed at the front end portion 82.

The first mixed fluid jet holes 84 are formed on the side wall section 81, the base end portion thereof communicates with the first recess 83, the front end portion thereof is open to the lateral side, and the multiple (eight in this embodiment) first mixed fluid jet holes 84 are provided in the circumferential direction about the axis O1 of the burner tip 71 at equal intervals. The first mixed fluid jet holes 85 are formed on the side wall section 81, the base end portion thereof communicates with the first recess 83, the front end portion thereof is open to the lateral side, and the multiple (eight in this embodiment) first mixed fluid jet holes 85 are provided in the circumferential direction about the axis O1 of the burner tip 71 at equal intervals. The second mixed fluid jet holes 86 are formed on the inclined surface section 82*b* of the front end portion 82, the base end portion thereof communicates with the first recess 83, the front end portion thereof is open to the front side, and the multiple (eight in this embodiment) second mixed fluid jet holes 86 are provided in the circumferential direction about the axis O1 of the burner tip 71 at equal intervals.

Moreover, the multiple first mixed fluid jet holes 84 are radially formed around a point O2 located on the axis O1, the multiple first mixed fluid jet holes 85 are radially formed around a point O3 located on the axis O1, and the multiple second mixed fluid jet holes 86 are radially formed around a point O4 located on the axis O1. In this case, since each of the points O2, O3 and O4 is set at predetermined intervals along the axis O1 direction, the first mixed fluid jet holes 84, the first mixed fluid jet holes 85, and the second mixed fluid jet holes 86 are formed at predetermined intervals in the axis O1 direction, and are provided to be parallel to one another.

Furthermore, the first mixed fluid jet holes 84 and the first mixed fluid jet holes 85 are disposed at the same position in the circumferential direction, and the first mixed fluid jet holes 84 and the second mixed fluid jet holes 86 are disposed at the same position in the circumferential direction.

The back plate 73 has a disk shape, and is formed with a second recess 91 having a cylindrical shape at a front end portion thereof. The second recess 91 formed on the back plate 73 faces the first recess 83 formed on the spray plate 72, and each of the recesses 83 and 91 is set to have substantially the same diameter. In this embodiment, a mixing chamber 92 is formed by the first recess 83 and the second recess 91, and a base end portion of each of the mixed fluid jet holes 84, 85 and 86 communicates with the mixing chamber 92.

In the back plate 73, a jet chamber 93 is formed on the outer peripheral side of the second recess 91 (mixing chamber 92) to have a ring shape along the circumferential direction. The jet chamber 93 communicates with the second recess 91 (mixing chamber 92) via the multiple (eight in this embodiment) communication passages 94. That is, each of the communication passages 94 is formed along the radial direction (radial direction) of the back plate 73, one end portion thereof communicates with the inner peripheral surface of the jet chamber 93, and the other end portion communicates with the outer peripheral surface of the second recess 91.

In addition, a plurality of steam supply passages (atomizing medium supply passages) 95 are provided on a central portion side of the back plate 73, and a plurality of fuel supply passages (fluid fuel supply passages) 96 are provided on the outer side of the plurality of steam supply passages 95. The respective steam supply passages 95 are provided in the back plate 73 along the longitudinal direction thereof, and the front end portions thereof communicate with the second recess 91. The respective fuel supply passages 96 are provided in the back plate 73 along the longitudinal direction thereof, and the front end portions thereof communicate with the jet chamber 93.

The connection plate 74 is formed with a connection chamber 103, and a plurality of (eight in this embodiment) connection passages 104 are formed around the connection chamber 103. The connection chambers 103 communicate with the respective steam supply passage 95, and the respective connection passages 104 communicate with the respective fuel supply passages 96, respectively.

The fuel supply pipe 22 and the steam supply pipe 25 are connected to the base end portion of the connection plate 74. The fuel supply pipe 22 is provided with a fuel supply passage 22*a* inside and is connected to the respective connection passages 104 by a fuel passage 105 formed in the connection plug 102. Meanwhile, the steam supply pipe 25 is provided with a steam supply channel 25*a* inside and is connected to the connection chamber 103 via a steam passage 107 formed in the connection plug 102.

For that reason, steam of the steam supply channel 25*a* can be supplied to the mixing chamber 92 along the axis O1 direction of the burner tip 71 through the steam passage 107, the connection chamber 103, and the multiple steam supply passages 95. Meanwhile, fuel in the fuel supply passage 22*a* can be supplied to the jet chamber 93 through the fuel passage 105, the respective connection passages 104, and the multiple fuel supply passages 96 and can be supplied to the mixing chamber 92 from the jet chamber 93 through the multiple communication passages 94 along the radial direction of the burner tip 71.

Here, the function of the burner tip 71 (the burner gun 59) of this embodiment described above will be described in detail. In addition, in FIG. 1, the flow of fuel is indicated by a black arrow, the flow of steam is indicated by a white arrow, and a fluid mixture obtained by mixing the fuel with the steam is indicated by an oblique arrow.

As illustrated in FIG. 1, at the burner tip 71, when the steam is supplied through the steam supply pipe 25, the steam is supplied to the mixing chamber 92 through the steam passage 107, the connection chamber 103, and the multiple steam supply passages 95 along the axis O1 direction. Furthermore, when the fuel is supplied through the fuel supply pipe 22, the fuel is supplied to the mixing chamber 92 from the outside through the fuel passage 105, the respective connection passages 104, the multiple fuel supply passages 96, the jet chamber 93, and the communication passage 94 along the radial direction.

Then, at the mixing chamber 92, the fuel supplied from the outside in the radial direction collides with the steam supplied along the axis O1 direction, and the fuel and the steam clash and are mixed with each other. That is, since the fuel supplied to be substantially perpendicular from the outside collides with the steam flowing to the front end side in the mixing chamber 92 along the axis O1 direction, the fuel is diffused by the steam and mixed. Also, since the fuel is supplied with respect to the mixing chamber 92 in the radial direction, the fuel does not linearly flow to the second mixed fluid jet hole 96 side, the residence time of the fuel in the mixing chamber 92 becomes longer, and the fuel is easily diffused by the steam.

Moreover, the fluid mixture efficiently mixed in the mixing chamber 92 flows to the front side of the mixing chamber 92, and is ejected (sprayed) to the outside through the respective mixed fluid jet holes 84, 85, and 86. At this time, each of the first mixed fluid jet holes 84 and 85 ejects the fluid mixture to the lateral side of the burner tip 71, and each of the second mixed fluid jet holes 86 ejects the fluid mixture to the front side of the burner tip 71. For that reason, the atomization of the fluid mixture ejected from the respective mixed fluid jet holes 84, 85 and 86 is hard to come into contact with each other, it is possible to reduce the atomized particle size of the fuel, and the fuel and the ambient air are satisfactorily mixed with each other.

The burner tip of this embodiment is provided with the mixing chamber 92 provided inside, the multiple first mixed fluid jet holes 84 and 85 disposed at predetermined intervals in the circumferential direction, a base end portion of which communicates with the mixing chamber 92 and the front end of which is open to the lateral side, the fluid fuel supply passage 96 configured to supply the fluid fuel to the mixing chamber 92, and the steam supply passage 95 configured to supply the steam into the mixing chamber 92.

Therefore, the fuel supplied from the fuel supply passage 96 and the steam supplied from the steam supply passage 95 are mixed with each other in the mixing chamber 92, and the fluid mixture is ejected to the outside by the plurality of mixed fluid jet holes 84, 85, and 86. At this time, since the first mixed fluid jet holes 84 and 85 are open to the lateral side, the atomization of the fluid mixture ejected from each of the first mixed fluid jet holes 84 and 85 is hard to come into contact with each other, and it is possible to reduce the atomized particle size of the fuel. As a result, the fuel and the ambient air are satisfactorily mixed with each other, thereby being able to improve the combustibility.

In the burner tip of this embodiment, the plurality of the first mixed fluid jet holes 84 and 85 are radially formed around a point located on the axis O1. Therefore, it is possible to improve the workability of the plurality of the mixed fluid jet holes 84 and 85 and reduce the manufacturing cost.

In the burner tip of this embodiment, the spray plate 72 has a side wall section 81 having a cylindrical shape along the axis O1 direction, and a front end portion 82 having a hemispherical shape provided at one end portion of the side wall section 81, and is formed with the plurality of first mixed fluid jet holes 84 and 85 through the side wall section 81 so as to extend from the mixing chamber 92 to the front end portion 82 side. Therefore, by forming the plurality of the first mixed fluid jet holes 84 and 85 on the side wall section 81 having a cylindrical shape, the fluid mixture can be ejected over a wide range, and it is possible to promote the mix of the fuel and the ambient air.

In the burner tip of this embodiment, the plurality of the first mixed fluid jet holes 84 and 85 are provided on the side wall section 81 to be parallel to each other at predetermined intervals in the axis O1 direction. Therefore, since the first mixed fluid jet holes 84 and 85 provided at predetermined intervals in the axis O1 direction are parallel to each other, the atomization of the fluid mixture injected from the respective first mixed fluid jet holes 84 and 85 is hard to come into contact with each other, and it is possible to promote the mix of the fuel and the ambient air.

In the burner tip of this embodiment, a plurality of the second mixed fluid jet holes 86 are provided at the front end portion 82 of the spray plate 72 at predetermined intervals in the circumferential direction, and the first mixed fluid jet holes 84 and 85 and the second mixed fluid jet holes 86 are disposed at the same position in the circumferential direction. Therefore, it is possible to promote the mix of the fuel and the ambient air in the atomization of the fluid mixture ejected from each of the mixed fluid jet holes 84, 85, and 86.

In the burner tip of this embodiment, a plurality of steam supply passages 95 are provided in the back plate 73 to be able to supply the steam to the mixing chamber 92 along the axis O1 direction, and a plurality of fuel supply passages 96 are provided in the back plate 73 on the outer side of the steam supply passages 95 to be able to supply the fuel to the mixing chamber 92 along the radial direction. Therefore, since the fuel is supplied with respect to the steam supplied to the mixing chamber 92 from the outside, it is possible to secure a long residence time of the fuel in the mixing chamber 92, and it is possible to promote the mix of the fuel and the steam in the mixing chamber 92.

Further, the combustion burner of this embodiment has the wind box 28, the fuel compartment 53, the burner gun 59, and a pair of upper and lower supplementary air compartments 54 and 55, and the burner tip 71 is disposed at the front end portion of the burner gun 59. Also, the boiler of this embodiment is a boiler that combusts the fuel and the air within the furnace 11 having a hollow shape and recovers heat by performing the heat exchange in the furnace 11, and the combustion burner 21 is disposed on the furnace wall.

Therefore, since the burner tip 71 disposed at the front end portion of the burner gun 59 is provided with a plurality of first mixed fluid jet holes 84 and 85 that inject the fluid mixture to the lateral side, the atomization of the fluid mixture ejected from each of the first mixed fluid jet holes 84 and 85 is hard to come into contact with each other, and it is possible to reduce the atomized particle size of the fuel. As a result, since the fuel and the ambient air are satisfactorily mixed with each other, it is possible to improve the combustibility.

In the above-described embodiment, the plurality of first mixed fluid jet holes 84 and 85 are provided on the side wall section 81 of the spray plate 72, and the plurality of second mixed fluid jet holes 86 are provided on the front end portion 82 of the spray plate 72, but the invention is not limited to this configuration. For example, only one of the first mixed fluid jet holes 84 and 85 may be provided on the side wall section 81 of the spray plate 72, and three or more kinds of the first mixed fluid jet holes may be provided. Furthermore, the plurality of second mixed fluid jet holes 86 are provided on the front end portion 82 of the spray plate 72, but the second mixed fluid jet holes 86 may not be provided, and the plurality of second mixed fluid jet holes may be provided along the radial direction.

Also, in the above-described embodiment, the spray plate 72 has the side wall section 81 and the front end portion 82, and the side wall section 81 has the cylindrical shape having the same outer diameter along the longitudinal direction, but the side wall section may have a conical (truncated cone) shape such that the front end portion becomes narrower. Also, the front end surface section 82*a* and the inclined surface section 82*b* are provided at the front end portion 82, but the front end portion 82 may have a spherical surface.

Also, in the above-described embodiment, the steam supply passage 95 is provided at the central portion, the fuel supply passage 96 is provided on the outer side thereof, and the fuel is supplied with respect to the steam supplied to the mixing chamber 92 from the outside, but the fuel and the steam may be reversed. That is, the fuel supply passage 96 may be provided at the central portion, the steam supply passage 95 may be provided on the outer side thereof, and the steam may be supplied with respect to the fuel supplied to the mixing chamber 92 from the outside.

Also, in the above-described embodiment, the combustion burner 21 has the wind box 28, the fuel compartment 53, the burner gun 59, and the pair of upper and lower supplementary air compartments 54 and 55, but the invention is not limited to this configuration. For example, the combustion burner may have the fuel passage disposed at the central portion of the wind box, the air passage disposed outside the fuel passage in the wind box, and the burner gun disposed at the central portion of the fuel passage.

REFERENCE SIGNS LIST

10 Oil combustion boiler
11 Furnace
12 Combustion unit
21 Combustion burner
22 Fuel supply pipe
25 Steam supply pipe
28 Wind box
53 Fuel compartment (fuel passage)
54 Upper supplementary air compartment (air passage)
55 Lower supplementary air compartment (air passage)
59 Burner gun
71 Burner tip
72 Spray plate (tip body)
73 Back plate (tip body)
74 Connection Plate (tip body)
75 Clamping Ring
81 Side Wall Section
82 Front end Portion
84, 85 First mixed fluid jet hole
86 Second mixed fluid jet hole
92 Mixing chamber
93 Jet chamber
94 Communication passage
95 Steam supply passage (atomizing medium supply passage)
96 Fuel supply passage (fluid fuel supply passage)

The invention claimed is:

1. A burner tip comprising:

a tip body with a side wall section having a cylindrical shape along an axial direction and a front end portion which is defined in a hemispherical shape and disposed at one end portion of the side wall section;

a mixing chamber provided inside the tip body;

a plurality of mixed fluid jet holes through which the mixing chamber is in communication with an outside of the tip body;

a plurality of atomizing medium supply passages which are provided on a base end side of the tip body to allow supply of an atomizing medium to the mixing chamber along an axial direction thereof; and a plurality of fluid fuel supply passages which are provided on the base end side of the tip body on an outer side of the atomizing medium supply passages to allow supply of a fluid fuel to the mixing chamber along a radial direction thereof, wherein the plurality of mixed fluid jet holes comprise a plurality of first mixed fluid jet holes which are provided on the side wall section at predetermined intervals in the axial direction and which penetrate the side wall section obliquely towards a front end portion side from the mixing chamber and a plurality of second mixed fluid jet holes provided on the front end portion, and wherein the first mixed fluid jet holes and the second mixed fluid jet holes disposed at a same position in a circumferential direction are provided in parallel.

2. The burner tip according to claim 1, wherein the plurality of first mixed fluid jet holes are radially defined, centering on an axis of the tip body.

3. The burner tip according to claim 1, wherein the plurality of first mixed fluid jet holes are provided on the side wall section in plural so as to be parallel to each other at predetermined intervals in the axial direction.

4. The burner tip according to claim 1, wherein the plurality of second mixed fluid jet holes are disposed at predetermined intervals in the circumferential direction.

5. A combustion burner comprising:

a wind box;

a fuel passage disposed in a central portion of the wind box;

an air passage disposed outside the fuel passage in the wind box;

a burner gun disposed in a central portion of the fuel passage; and the burner tip according to claim 1 disposed at a front end portion of the burner gun.

6. A boiler configured to combust fuel and air in a furnace having a hollow shape and recover heat by performing heat exchange in the furnace, the boiler comprising:

the combustion burner according to claim 5 disposed on a furnace wall.

7. The burner tip according to claim 1, wherein the plurality of first mixed fluid jet holes are open to a lateral side of the tip body, and are disposed at predetermined intervals in a circumferential direction of the tip body.

8. The burner tip according to claim 4, wherein the plurality of second mixed fluid jet holes are defined on an inclined surface section of the front end portion.

9. The burner tip according to claim 1, wherein:

a back plate having a disk shape is provided on the base end side of tip body, the plurality of atomizing medium supply passages are provided on a central portion side of the back plate, the plurality of fluid fuel supply passages are provided on an outer peripheral side of the back plate, and a plurality of communication passages, through which the plurality of atomizing medium supply passages and the plurality of fluid fuel supply passages are connected, are provided along a radial direction of the back plate.

* * * * *